US012390012B2

(12) United States Patent
Nisley

(10) Patent No.: US 12,390,012 B2
(45) Date of Patent: Aug. 19, 2025

(54) ANTI-TIP FURNITURE DEVICE

(71) Applicant: John J. Nisley, Dundee, OH (US)

(72) Inventor: John J. Nisley, Dundee, OH (US)

( * ) Notice: Subject to any disclaimer, the term of this patent is extended or adjusted under 35 U.S.C. 154(b) by 135 days.

(21) Appl. No.: 18/333,618

(22) Filed: Jun. 13, 2023

(65) Prior Publication Data

US 2024/0122344 A1 Apr. 18, 2024

Related U.S. Application Data

(60) Provisional application No. 63/417,137, filed on Oct. 18, 2022.

(51) Int. Cl.
*A47B 97/00* (2006.01)

(52) U.S. Cl.
CPC ..... *A47B 97/00* (2013.01); *A47B 2097/008* (2013.01)

(58) Field of Classification Search
CPC ... A47B 97/00; A47B 2097/008; A47B 88/50; A47B 88/57
See application file for complete search history.

(56) References Cited

U.S. PATENT DOCUMENTS 1,238,514 A * 8/1917 Hartbeck ..... A47B 88/467 109/47
2,873,159 A * 2/1959 Becker ..... A47B 17/036 312/333
3,361,509 A * 1/1968 Levenberg ..... A47B 88/70 312/273
RE26,902 E * 5/1970 Levenberg ..... E05B 65/466 312/273
3,602,562 A * 8/1971 Radelfinger ..... A47F 3/002 116/99
5,062,678 A * 11/1991 Westwinkel ..... E05B 65/466 312/221
5,392,951 A * 2/1995 Gardner ..... G07F 17/0092 221/244
6,170,927 B1 * 1/2001 Dykstra ..... E05B 65/466 312/220
10,405,655 B2 * 9/2019 Nelson ..... E05B 65/466
2005/0283950 A1 * 12/2005 Portelli ..... A47B 95/02 16/441

(Continued)

FOREIGN PATENT DOCUMENTS

CN 108378586 A * 8/2018 ..... A47B 67/04
CN 114698961 A * 7/2022
KR 20220070933 A * 5/2022

*Primary Examiner* — Daniel J Rohrhoff
(74) *Attorney, Agent, or Firm* — Brennan, Manna & Diamond, LLC

(57) ABSTRACT

An anti-tip furniture device is provided. The device prevents furniture with drawers from tipping due to all, or most drawers being opened at the same time. The device is primarily comprised of at least one piece of furniture which is comprised of at least one drawer with at least one eyelet, at least one line, and at least one counterweight. The drawer of the device has an eyelet positioned on the rear wall of the drawer. The line attaches to the exterior frame and runs vertically and/or horizontally through each eyelet of each drawer. The line is held in position via the counterweight. When one drawer of the device is opened, the line is tightened such that all other drawers cannot be opened fully. This prevents tipping of the device.

17 Claims, 4 Drawing Sheets

(56) References Cited

U.S. PATENT DOCUMENTS

| | | | | |
|---|---|---|---|---|
| 2006/0097123 | A1* | 5/2006 | Gallien | A47B 97/00<br>248/500 |
| 2010/0295433 | A1* | 11/2010 | Randall | E05B 65/466<br>312/333 |
| 2024/0315445 | A1* | 9/2024 | Lin | A47B 88/50 |

* cited by examiner

ANTI-TIP FURNITURE DEVICE

CROSS-REFERENCE TO RELATED APPLICATION

The present application claims priority to, and the benefit of, U.S. Provisional Application No. 63/417,137, which was filed on Oct. 18, 2022, and is incorporated herein by reference in its entirety.

FIELD OF THE INVENTION

The present invention relates generally to the field of furniture. More specifically, the present invention relates to an anti-tip furniture device with a counterweight suspended from a line attached to a draw of the device. When a drawer of the device is opened, the line is tightened such that all other drawers can only be partially opened, and the device is prevented from tipping. Accordingly, the present disclosure makes specific reference thereto. Nonetheless, it is to be appreciated that aspects of the present invention are also equally applicable to other like applications, devices, and methods of manufacture.

BACKGROUND

Many young children may climb on and/or open drawers of furniture. If all or most drawers of a piece of furniture are open at one time, the furniture can easily tip over. Because almost half of furniture tip over injuries happen in the head and neck area, the injuries are often significant or fatal. A study by the Nationwide Children's Hospital spanning 30 years found that of all incidents of children being harmed by toppling furniture 575 incidents were fatal. Further, an estimated 18,000 Americans went to emergency rooms across the U.S. in 2020 for injuries sustained when furniture, a TV, or another appliance tipped over and hurt them.

Therefore, there exists a long-felt need in the art for a device that provides a piece of furniture that cannot easily tip and injure nearby individuals. More specifically, there exists a long-felt need in the art for an anti-tip furniture device that provides a dresser or other similar piece of furniture that cannot tip over due to all, or most drawers of the device being pulled outwards at one time. In addition, there exists a long-felt need in the art for an anti-tip furniture device that contains no visible external safety features that disrupt the visual appearance of the furniture.

The subject matter disclosed and claimed herein, in one embodiment thereof, comprises an anti-tip furniture device. The device is primarily comprised of at least one piece of furniture, the furniture is comprised of at least one drawer with at least one eyelet, at least one line, and at least one counterweight. The furniture is preferably a dresser, wherein each drawer of the dresser has an eyelet positioned on the rear wall of the drawer. The line attaches to the exterior frame and runs vertically through each eyelet. The line is held in position via the counterweight. When one drawer is opened, the line is tightened such that all other drawers can only be partially opened.

In this manner, the anti-tip furniture device of the present invention accomplishes all of the foregoing objectives and provides a piece of furniture that cannot easily tip and injure nearby individuals. More specifically, the line prevents all or more than one drawer of the device from being completely pulled outwards at one time. As a result, the device greatly reduces the likelihood of tipping. While doing so, the device has no visible external safety features that disrupt the visual appearance of the furniture.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an anti-tip furniture device primarily comprised of at least one piece of furniture, the furniture is comprised of at least one drawer with at least one eyelet, at least one line, and at least one counterweight. In differing embodiments, the furniture may be any furniture type known in the art such as, but not limited to, a dresser, a desk, a nightstand, a chest, etc., or any furniture type with at least one drawer. In the preferred embodiment, the furniture is a vertical or horizontal dresser with at least one drawer.

The rear wall of the drawer is comprised of at least one eyelet having at least one opening. In the preferred embodiment, the eyelet is comprised of a threaded, pointed tip that can be screwed into the rear wall, such that the eyelet is secured to the rear wall. In the preferred embodiment, each drawer of the furniture has at least one eyelet. All eyelets of each drawer are preferably positioned in the same position on the rear wall of each drawer such that they align within the frame. In this manner, at least one line can be fed through the opening of each eyelet within the frame.

The line preferably attaches to a bottom surface of a top wall of the exterior frame. The line is also comprised of at least one counterweight. In one embodiment, the counterweight is comprised of at least one removable section that can be removed to allow the counterweight to be lightened to produce the desired amount of slack in the line relative to the weight in each drawer.

During use, the line runs through each eyelet of each drawer. When one drawer is opened (i.e., pulled away from the frame) the line tightens. As a result, all other drawers will then not open fully as the line does not contain enough slack to allow the other drawers to fully open. In this manner, multiple drawers of the furniture cannot be opened at the same time. This prevents the furniture from tipping due to all or most drawers being extended at once.

Accordingly, the anti-tip furniture device of the present invention is particularly advantageous as it provides a piece of furniture that cannot easily tip and injure nearby individuals by preventing all, or more than one, drawers of the device from being pulled outwards at one time. As a result, the device greatly reduces the likelihood of tipping. In addition, the device has no visible external safety features that disrupt the visual appearance of the furniture. In this manner, the anti-tip furniture device provides a novel solution to reduce furniture from tipping over.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents.

Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
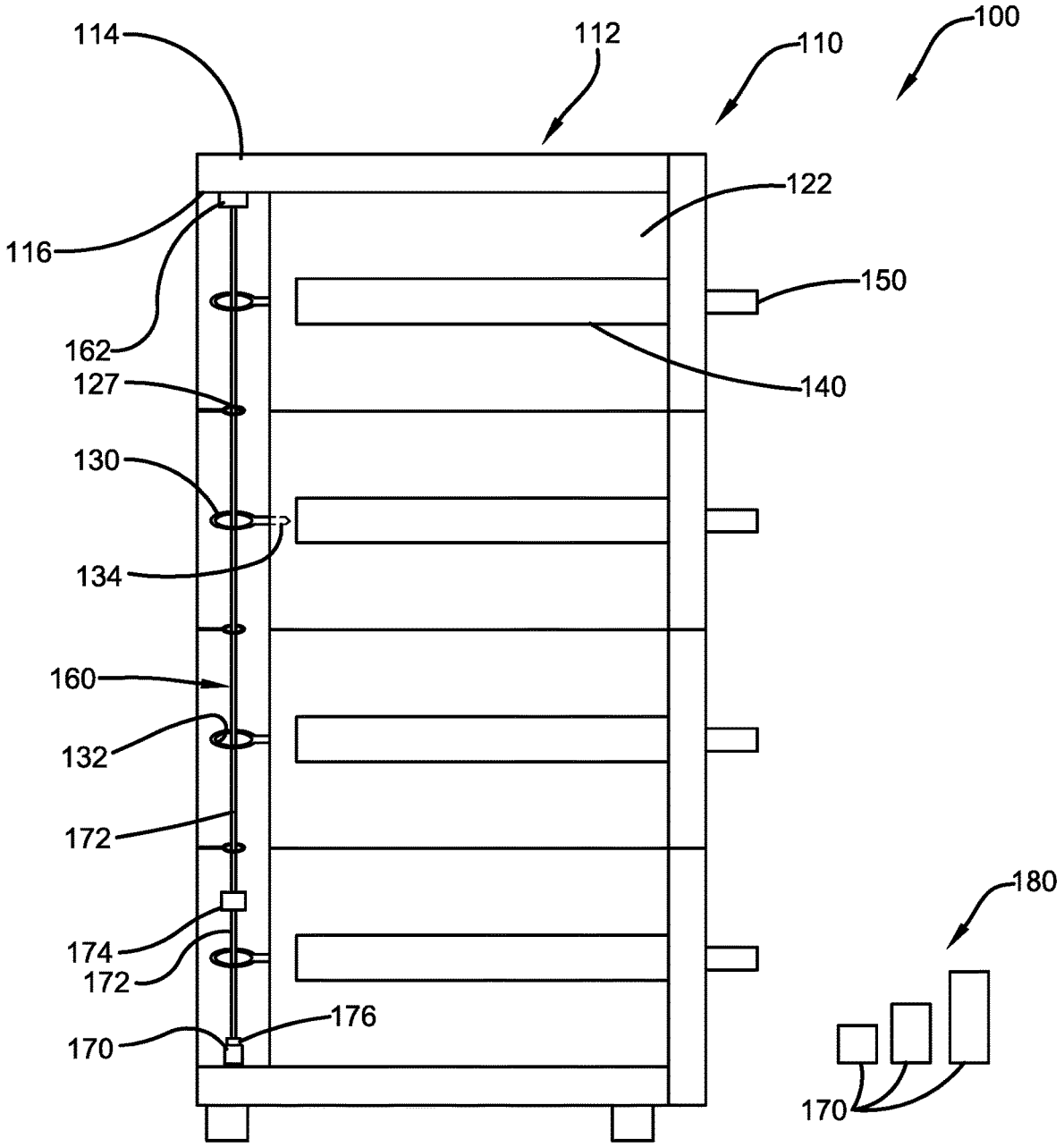
FIG. 1 illustrates a cross-sectional side view of one potential embodiment of an anti-tip furniture device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device that provides a piece of furniture that cannot easily tip and injure nearby individuals. More specifically, there exists a long-felt need in the art for an anti-tip furniture device that provides a dresser or other similar piece of furniture that cannot tip over due to all, or most drawers of the device being pulled outwards at one time. In addition, there exists a long-felt need in the art for an anti-tip furniture device that contains no visible external safety features that disrupt the visual appearance of the furniture.

The present invention, in one exemplary embodiment, is comprised of an anti-tip furniture device primarily comprised of at least one piece of furniture. The furniture is comprised of at least one drawer with at least one eyelet, at least one line, and at least one counterweight. In differing embodiments, the furniture may be any furniture type known in the art such as, but not limited to, a dresser, a desk, a nightstand, a chest, etc., or any furniture type with at least one drawer. However, in the preferred embodiment, the furniture is a vertical or horizontal dresser with at least one drawer.

The rear wall of the drawer is comprised of at least one eyelet. The eyelet is attached to a rear wall of the drawer, such that the eyelet is secured to the rear wall. In the preferred embodiment, each drawer of the furniture has at least one eyelet. All eyelets of each drawer are preferably positioned in the same position on the rear wall of each drawer such that they align within the frame. In this manner, at least one line can be fed through the opening of each eyelet within the frame of the furniture.

The line preferably attaches to a bottom surface of a top wall of the exterior frame. The line is also comprised of at least one counterweight. The counterweight may be comprised of at least one removable section that can be removed to allow the counterweight to be lightened to produce the desired amount of slack in the line relative to the weight in each drawer.

During use, the line runs through each eyelet of each drawer. When one drawer is opened (i.e., pulled away from the frame) the line tightens. As a result, all other drawers will then not open as the line does not contain enough slack to allow the other drawers to fully open. In this manner, multiple drawers of the furniture cannot be opened at the same time. This prevents the furniture from tipping due to all or most drawers being extended at once.

Accordingly, the anti-tip furniture device of the present invention is particularly advantageous as it provides a piece of furniture that cannot easily tip and injure nearby individuals by preventing all, or more than one, drawers of the device from being pulled outwards at one time. As a result, the device greatly reduces the likelihood of tipping. In addition, the device has no visible external safety features that disrupt the visual appearance of the furniture. In this manner, the anti-tip furniture device provides a novel solution to reduce furniture from tipping over.

Referring initially to the drawings, FIG. 1 illustrates a cross-sectional side view of one potential embodiment of an anti-tip furniture device 100 of the present invention in accordance with the disclosed architecture. The device 100 is primarily comprised of at least one piece of furniture 110, the furniture 110 is comprised of at least one drawer 120 with at least one eyelet 130, at least one line 160, and at least one counterweight 170. In differing embodiments, the furniture 110 may be any furniture type known in the art. This includes, but is not limited to, a dresser, a desk, a nightstand, a chest, etc., or any furniture type with at least one drawer 120. The furniture 110 may be made from any wood material known in the art. The furniture 110 may also be made of any metal, plastic, marble, glass, fabric, laminate, or synthetic material known in the art.

Figure 3:
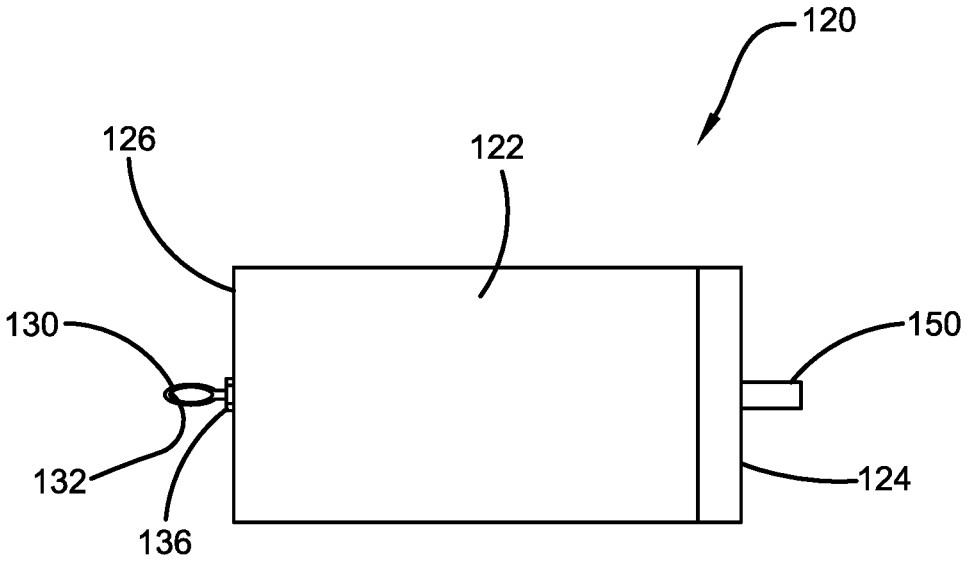
FIG. 3 illustrates a side view of a drawer of one potential embodiment of an anti-tip furniture device of the present invention in accordance with the disclosed architecture.

In the preferred embodiment, the furniture 110 is a vertical or horizontal dresser with at least one drawer 120, as seen in FIG. 3. The drawer 120 is preferably rectangular in shape and has a pair of parallel side walls 122 and a front wall 124 that is parallel to a rear wall 126. The front wall 124 may be comprised of any handle 150 type known in the art that allows a user to easily open the drawer 120.

Each side wall 122 is comprised of at least one track 140. The track 140 allows the drawer 120 to slide in and out from the exterior frame 112 of the furniture 110. The track 140 may be any track type known in the art, such as, but not limited to, a soft-close track or any cabinet track/glide known in the art.

The rear wall 126 of the drawer 120 is comprised of at least one eyelet 130. The eyelet 130 is comprised of at least one opening 132. The eyelet 130 may be an opened or closed eyelet in different embodiments. In one embodiment, the eyelet 130 is comprised of a threaded, pointed tip 134 that can be screwed into the rear wall 126 such that the eyelet 130 is secured to the rear wall 126. In a differing embodiment, the eyelet 130 is comprised of at least one fastener 136 that allows the eyelet 130 to removably attach to the rear wall 126. In this manner, the eyelet 130 can be used with the drawer 120 in a manner that does not damage the rear wall 126 permanently. The fastener 136 may be any fastener type known in the art such as, but not limited to, a magnet, an adhesive, hook and loop, etc. In a further embodiment, the rear wall 126 is comprised of at least one opening 128. The opening 128 allows the eyelet 130 to be placed through the rear wall 126. In this embodiment, the eyelet 130 is comprised of a threaded eyelet, which can be secured within the opening 128 from the inside of the drawer 120 via a nut 129, pin, or other fastener of the like.

In the preferred embodiment, each drawer 120 of the furniture 110 has at least one eyelet 130, and wherein all eyelets 130 are positioned in the same position on the rear wall 126 of each drawer 120 such that they align within the frame 112. In this manner, at least one line 160 can be fed through the opening 132 of each eyelet 130 within the frame 112. In one embodiment, the rear wall 126 is also comprised of at least one eyelet 127 that also receives the line 160. This eyelet 127 is preferably a screw-in eyelet that can be attached to the rear wall 126 (or any other wall such as but not limited to the bottom surface 116 of the top wall 114).

The line 160 is preferably comprised of a durable material. In one embodiment, the line 160 is preferably comprised of any type of braided Kevlar line material known in the art. In another embodiment, the line 160 is comprised of a rope such as, but not limited to, natural rope, a synthetic rope, a single braid rope, a plaited rope, a twisted rope, a double braid rope, a hollow rope, a manila rope, a polypropylene rope, a nylon rope, a bungee shock cord, etc.

The line 160 preferably attaches to a bottom surface 116 of a top wall 114 of the exterior frame 112 via the eyelet 127. The line 160 preferably attaches via at least one line fastener 162. The line fastener 162 may be a plurality of fastener types in differing embodiments such as, but not limited to, an eyelet, a screw, a bolt, an adhesive, etc. From the fastener 162, the line 160 extends downward and is fed through each eyelet 130 of each drawer 120. The line 160 may run horizontally and/or vertically in different embodiments.

The line 160 is also comprised of at least one counterweight 170. The counterweight 170 may be any weight-type known in the art such as, but not limited to, a fabricated steel counterweight, a cast lead counterweight, a cast iron counterweight, etc. In one embodiment, the counterweight 170 is comprised of at least one removable section 172. The section 172 can be removed from counterweight 170 to allow the counterweight 170 to be lightened to produce the desired amount of slack in the line 160, or additional counterweights can be added to the line 160 if needed to compensate for drawer weight. In one embodiment, the device 100 is comprised of a kit 180 of a plurality of counterweights 170 of differing weights and/or each with a differing number of sections 172.

Figure 4:
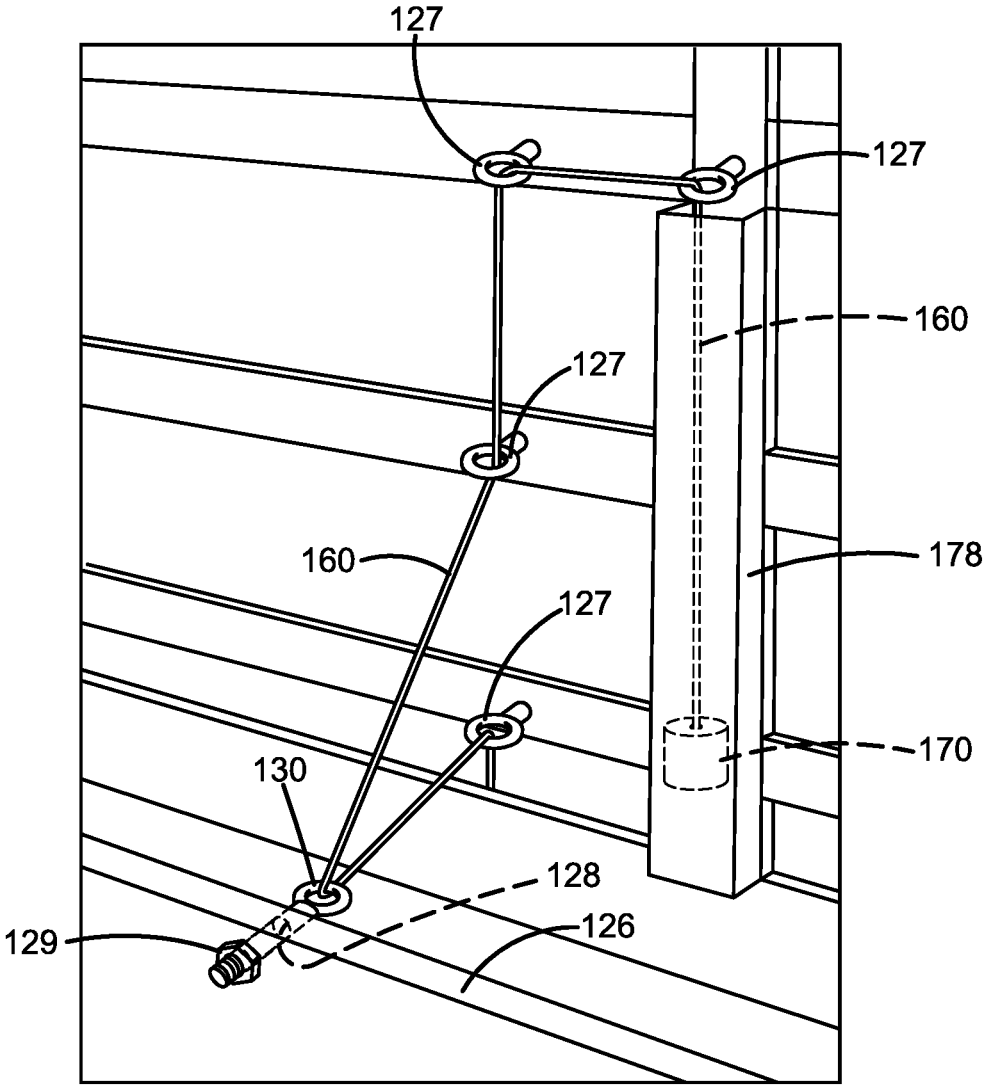
FIG. 4 illustrates a perspective view of an inside of one potential embodiment of an anti-tip furniture device of the present invention in accordance with the disclosed architecture.

In one embodiment, the counterweight 170 is contained within at least one open or fully enclosed channel 178, as seen in FIG. 4. The channel 178 may be positioned on the interior or exterior surface of any wall of the frame 112 (i.e., top wall, side walls, rear wall, bottom wall) of the furniture 110 in different embodiments. In the preferred embodiment, the channel 178 and counterweight 170 are rectangular, but may be any shape in different embodiments.

In one embodiment, each section 172 is comprised of at least one fastener 174 that allows each section 172 to attach to one another to form the counterweight 170. The fastener 174 may be any type known in the art such as, but not limited to, hook and loop, magnetic, adhesive, etc. In a further embodiment, the counterweight 170 is comprised of at least one counterweight fastener 176 that allows the line 160 to removably attach to the counterweight 170. The fastener 176 may be any fastener type such as, but not limited to, an eyelet, a bolt, a screw, etc.

Figure 2:
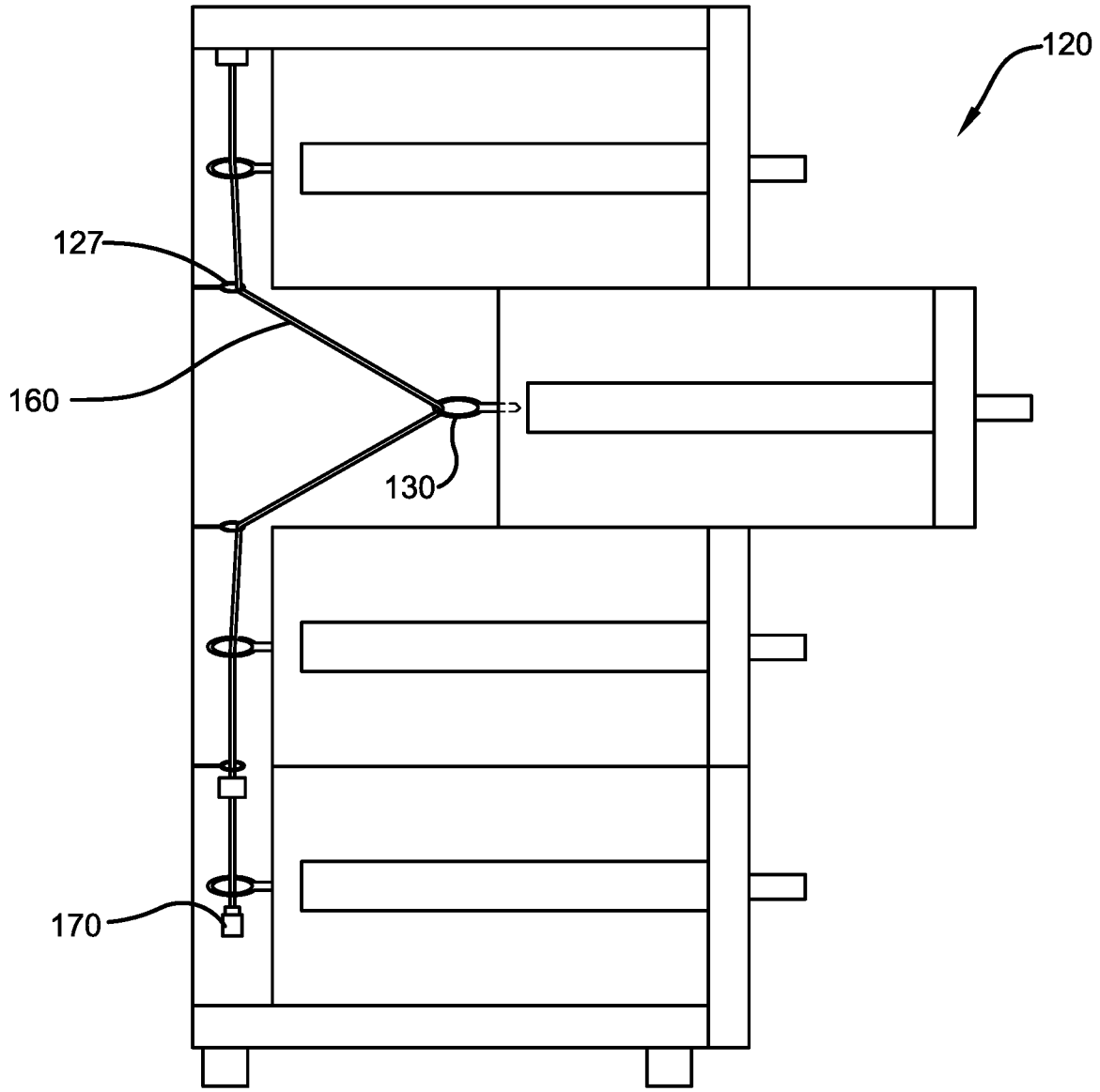
FIG. 2 illustrates a cross-sectional side view of one potential embodiment of an anti-tip furniture device of the present invention in accordance with the disclosed architecture.

During use, the line 160 runs through each eyelet 130, 127. When one drawer 120 is opened (i.e., pulled away from the frame 112 along the track 140) the line 160 tightens. As a result, all other drawers 120 will then not open, or open only partially (i.e., not enough to tip the device 100), as the line 160 does not contain enough slack to allow the other drawers to move, as seen in FIG. 2. In this manner, multiple drawers 120 of the furniture 110 cannot be opened at the same time. This prevents the furniture 110 from tipping due to all or most drawers 120 being extended at once. In one embodiment, a user can un-attach any drawer 120 from the line 160 as desired to allow the drawer 120 to fully open. In addition, larger furniture 110 may have a plurality of lines 160 and counterweights 170 to account for the large size and weight of the drawers 120.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "anti-tip furniture device" and "device" are interchangeable and refer to the anti-tip furniture device 100 of the present invention.

Notwithstanding the foregoing, the anti-tip furniture device 100 of the present invention and its various components can be of any suitable size and configuration as is known in the art without affecting the overall concept of the invention, provided that they accomplish the above-stated objectives. One of ordinary skill in the art will appreciate that the size, configuration and material of the anti-tip furniture device 100 as shown in the FIGS. are for illustrative purposes only, and that many other sizes and shapes of the anti-tip furniture device 100 are well within the scope of the present disclosure. Although the dimensions of the anti-tip furniture device 100 are important design parameters for user convenience, the anti-tip furniture device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An anti-tip furniture device comprising:

a piece of furniture comprising:

an exterior frame;

a drawer;

an eyelet;

a line; and a counterweight comprising a plurality of weighted sections, wherein each weighted section is removably attachable to another weighted section.

2. The anti-tip furniture device of claim 1, wherein the piece of furniture is comprised of a dresser, a desk, a nightstand, or a chest.

3. The anti-tip furniture device of claim 1, wherein the line is positioned through the eyelet.

4. An anti-tip furniture device comprising:

a piece of furniture comprising:

an exterior frame;

a drawer comprised of a track and a handle;

a fastener;

a line; and a counterweight attached to the line; and wherein the counterweight comprises a plurality of weighted sections;

wherein each weighted section is removably attachable to another weighted section; and wherein each weighted section is a different weight than the other weighted sections.

5. The anti-tip furniture device of claim 4, wherein the fastener is positioned on a rear wall of the drawer.

6. The anti-tip furniture device of claim 4, wherein the fastener is comprised of an eyelet.

7. The anti-tip furniture device of claim 6, wherein the eyelet is comprised of a threaded, pointed tip.

8. The anti-tip furniture device of claim 4, wherein the line is comprised of a Kevlar line material.

9. The anti-tip furniture device of claim 4, wherein the track attaches to the exterior frame.

10. An anti-tip furniture device comprising:

a dresser comprising:

an exterior frame;

a drawer comprised of a track and a handle;

an eyelet positioned on a rear wall of the drawer;

a line positioned through the eyelet; and a counterweight attached to the line via a counterweight fastener; and a vertical enclosed channel attached to the exterior frame for retaining the counterweight; and wherein the counterweight comprises a plurality of weighted sections;

wherein each weighted section is magnetically attachable to another weighted section; and wherein each weighted section is a different weight than the other weighted sections.

11. The anti-tip furniture device of claim 10, wherein the track is comprised of a cabinet track or a cabinet slide.

12. The anti-tip furniture device of claim 10, wherein the eyelet attaches to the rear wall via a first fastener.

13. The anti-tip furniture device of claim 12, wherein the first fastener is comprised of a magnet, an adhesive, or a hook and loop fastener.

14. The anti-tip furniture device of claim 10, wherein the line is comprised of a natural rope, a synthetic rope, a single braid rope, a plaited rope, a twisted rope, a double braid rope, a hollow rope, a manila rope, a polypropylene rope, a nylon rope, or a bungee shock cord.

15. The anti-tip furniture device of claim 10, wherein the line attaches to a bottom surface of a top wall of the exterior frame.

16. The anti-tip furniture device of claim 10, wherein the counterweight fastener is comprised of an eyelet, a bolt, or a screw.

17. The anti-tip furniture device of claim 10, wherein the eyelet is comprised of a threaded, pointed tip.

* * * * *